United States Patent [19]

Sherman

[11] Patent Number: 4,630,974

[45] Date of Patent: Dec. 23, 1986

[54] ROOF SUPPORT SYSTEM FOR A MINE AND METHOD FOR PROVIDING THE SAME

[75] Inventor: James L. Sherman, Bethel Park, Pa.

[73] Assignee: Price & Adams, Pittsburgh, Pa.

[21] Appl. No.: 711,302

[22] Filed: Mar. 13, 1985

[51] Int. Cl.[4] ..... E21D 21/00

[52] U.S. Cl. ..... 405/288; 405/259

[58] Field of Search ..... 405/259, 260, 262, 288; 411/337, 400; 248/222.4, 223.1, 223.2

[56] References Cited

U.S. PATENT DOCUMENTS

| | | | |
|---|---|---|---|
| 628,416 | 7/1899 | Robinson | 411/400 X |
| 1,955,353 | 4/1934 | Wiley | 411/400 |
| 2,246,457 | 6/1941 | Schultz | 248/222.4 X |
| 2,667,037 | 1/1954 | Thomas et al. . | |
| 3,303,735 | 2/1967 | Fisher | 411/400 |
| 3,427,811 | 2/1969 | White | 405/259 |
| 3,505,824 | 4/1970 | White | 405/259 |
| 3,509,726 | 5/1970 | White . | |
| 3,727,660 | 4/1973 | Burge | 411/337 |
| 3,731,956 | 5/1973 | Hanley | 248/223.1 X |
| 4,274,762 | 6/1981 | Johnson | 405/259 |
| 4,349,300 | 9/1982 | Kelley | 405/259 X |
| 4,395,161 | 7/1983 | Wilson et al. | 405/259 |
| 4,498,816 | 2/1985 | Korpela et al. | 405/259 |

FOREIGN PATENT DOCUMENTS

| | | | |
|---|---|---|---|
| 326441 | 5/1935 | Italy | 411/400 |

OTHER PUBLICATIONS

"Current Trends in Roof Truss Hardware", by C. P. Mangelsdorf, University of Pittsburgh, Jul. 19–21, 1982, pp. 1–5.

"Hydraulic Tensioning of a Birmingham Roof Truss", by C. W. Bollier, Peabody Coal Company, pp. 104–112.

Mine Controls Bad Roof with Trusses Bolted on Cycle, by Ken Barish; Coal Age, 5/85, pp. 62–66.

*Primary Examiner*—Cornelius J. Husar
*Assistant Examiner*—Nancy J. Stodola
*Attorney, Agent, or Firm*—Stanley J. Price, Jr.

[57] ABSTRACT

An improved roof support system for a mine or the like is of the type which includes a pair of plates secured to a roof of the mine at opposite sides thereof adjacent opposing ribs of the mine and an enlongated reinforcing member extending horizontally and transversely of the mine between the pair of plates. The reinforcing member has a first rod and a second rod threadably joined to an adjustable sleeve for joining the first rod and the second rod while being able to vary an overall length of the reinforcing member. Each of the rods has a bolt head thereon including a transversely extending working surface. Each of the plates has an opening therein for respective receipt of the bolt heads of the first rod and the second rod of the reinforcing member therethrough. Each of the plates has a force bearing surface adjacent the opening therein which is capable of respectively making contact at least a part of working surface of the first rod and the second rod. The reinforcing member is capable of producing tension between the plates as each of the working surfaces respectively makes contact with its corresponding force bearing surface. The tension can be varied by rotation of one of the rods relative to the sleeve. There is also included a method of supporting a roof of a mine or the like.

14 Claims, 9 Drawing Figures

ROOF SUPPORT SYSTEM FOR A MINE AND METHOD FOR PROVIDING THE SAME

BACKGROUND OF THE INVENTION

1. Field of the Invention

This invention relates to an improved roof support system for a mine or the like and, more specifically, to such a roof support system which utilizes a horizontal, transverse reinforcing member which is simple to provide and conveniently utilized to produce a desired tension between a pair of roof plates of the roof support system.

2. Description of the Prior Art

Although there are numerous methods for supporting the roof of mines, openings, or the like, one type which is commonly employed includes a roof truss structure which generally includes two inclined cords and a horizontal cord. The inclined cords are usually mine roof bolts or the like which extend into holes in the mine roof at about a 45° angle. The mine roof bolts may be anchored in the inclined holes in the roof by well known means such as expansion shells and/or resin bonding. The horizontal cord or tie member extends transveresly across the roof of the mine between the terminal ends of the inclined cords located at the surface of the roof. Providing means for applying tension to the anchored, inclined cords and the horizontal cords can result in sufficient upward force being generated on the roof to allow safe operation in the mine or the like while preventing uncontrolled vertical downward movement of the roof or any other creeping movement thereof which might cause it to become unstable.

U.S. Pat. No. 2,667,037 disclosed a general roof support system which basically provides the type of upward forces described hereinabove. Specifically, a horizontal beam or the like was positioned transversely of the mine opening across the roof and was retained in place by a plurality of inclined bolts which anchored the horizontal beam and provided overall integrity for roof support.

U.S. Pat. No. 3,427,811 disclosed a system which provided for the same type of upward forces to support a mine roof but included the additional feature of a means for varying the tension on the horizontal cord and reportedly resulted in an overall system which exerted at least approximately equal tension on the horizontal cord and the inclined anchoring cords. Although U.S. Pat. Nos. 3,505,824 and 3,509,726 disclose roof support trusses or systems which function generally like that mentioned hereinabove, they employ different elements to create a combined tension on the inclined cord and horizontal cord components.

The roof support system generally disclosed in U.S. Pat. No. 4,395,161 results in a similar configuration but includes features for ease of installation and adjustability which may exist in the prior art devices mentioned hereinabove but are not as clearly demonstrated. Specifically, the device includes a pair of transition plates to be installed in the roof of the mine by inclined cords in the form of mine roof bolts which can be separately installed and adjusted to provided the desired tension thereto. Subsequently, the same or a different mining crew is then capable of installing a horizontal, transveresly extending reinforcing member to provide the horizontal cord component of the mine roof truss. In the case of U.S. Pat. No. 4,395,161, the reinforcing member is disclosed to preferably be an elongated rod having threaded ends with adjusting nuts installed at each of the ends to produce tension between the transition plates.

When trying to determine which truss system or other roof support system should be utilized there are some mine operating conditions and safety requirements which should be taken into consideration. A more attractive roof support system would be one which could reduce installation time to mining cycle time, which includes a means to provide uniform truss tensioning during installation with a capability to vary tensioning depending upon roof conditions and which would improve the overall work conditions. These objectives were founded on the need to increase the effectiveness of the truss in roof support and reduce the cost of roof control. It is well known that roof control effectiveness can be enhanced by quickly supporting the roof after coal extraction. By installing the truss in the mining cycle, the time that the roof remains unsupported by the truss is decreased. By tensioning uniformly, a way is open for the truss to become the primary roof control method, thus reducing the requirement in many cases for roof bolting and trussing in the same location.

Further, it has been found that proper truss tensioning improves system effectiveness. Using a pipewrench as a tensioning tool has shown considerable variablity in truss tensioning during installation and tensioning is dependent upon the size and strength of the operator and the time of day in which the truss is installed. For example, early in a work shift, trusses are usually installed with proper tensioning, but as the day wears on the quality of workmanship declines as in many other industries.

Truss tensioning is an unpopular task because conditions in some mining areas create an unnatural strenuous working position for the individual actually tensioning the truss. To gain a greater acceptance of this operation, any improvement in such a system which could reduce the installation time, reduce the strenuous nature of the work and eliminate the potential for strain-type of injuries would be desireable.

Accordingly, while the device shown in U.S. Pat. No. 4,395,161 incorporates separate installation of a roof plate with a separately adjustable inclined mine roof bolt, any improvement to the horizontal, transveresly extending reinforcing member would be desirable. Further, it would clearly be an advantage if a more simplified means were available for installing such a horizontal, transverse reinforcing member which method also facilitated the use of power tools for creating the desired tension between the roof plates.

SUMMARY OF THE INVENTION

In accordance with the present invention, there is provided an improved support system for a mine or the like of the type includes a pair of plates secured to a roof of the mines at opposite sides thereof adjacent opposing ribs of the mine and an elongated reinforcing member extending horizontally and transversely of the mine between the pair of plates. The improvement includes the reinforcing member having a first rod means and a second rod means and adjustable means for joining the first rod means and the second rod means to vary an overall length of the reinforcing member. Each of the first rod means and the second rod means has an enlarged terminal end portion thereof which includes a transversely extending working surface. A first and a second of the pair of plates each has an opening therein for respective receipt of the enlarged terminal end portion of the first rod means and the second rod means of the reinforcing member therethrough. Each of the first plate and the second plate has a force bearing surface adjacent the opening therein capable of respectively making contact with at least a part of the working surface of the first rod means and the second rod means. The reinforcing member is capable of producing tension between the first plate and the second plate as each part of the surface respectively makes contact with its corresponding force bearing surface with the tension being varied by the adjustable means for joining the first rod means and the second rod means.

Further in accordance with the present invention there is provided a method of supporting a roof of a mine or the like including the steps of providing a first rod means with a first end having an enlarged terminal end portion thereof and threaded coupling means on a second end thereof. The terminal end portion of the first rod means has transversely extending working surface thereon. The method includes providing a second rod means having a first end having an enlarged terminal end portion thereof and a second end thereof which is in threaded engagement with the threaded coupling means on the second end of the first rod means. The terminal end portion of the second rod means has a transversely extending working surface thereon. There is provided a first and a second roof support plates which are capable of being secured to the roof. The first roof support plate has an opening therein for receipt of the terminal end portion of the first rod means therethrough with a force bearing surface thereon adjacent the opening and the second roof support plate has an opening therein receipt of the terminal end portion of the second rod means therethrough with a force bearing surface thereon adjacent the opening. The method includes securing the first plate and the second plate at opposite sides of the roof at adjacent opposing ribs of the mine with the force bearing surfaces thereon respectively towards the adjacent rib and with the force bearing surfaces of the first plate and the second plate being a predetermined distance apart. The next step includes adjusting an overall length of the first rod means and the second rod means between the working surfaces thereof to slightly exceed the predetermined distance. The enlarged terminal end portion of one of the first rod means and the second rod means is inserted through the opening of a corresponding one of the first plate and the second plate. At least a part of the working surface of the enlarged terminal end portion is aligned with the force bearing surface of the corresponding one plate. The enlarged terminal end portion of the other of the first rod means and the second rod means is inserted through the opening of the corresponding other of the first plate and the second plate. At least a part of the working surface of the enlarged terminal end portion is aligned with the force bearing surface of the corresponding other plate. The overall length between the working surfaces of the first rod means and the second rod means is reduced by relative rotation of the coupling means and the second rod means to increase the threaded engagement of the second end of the second rod means with the coupling means until the force bearing surfaces are respectively in contact with at least a part of the working surfaces. Tension is produced between the first plate and the second plate by continued relative rotation of the coupling means and the second rod means.

Consequently, it is a primary object of the invention to provide an improved roof support system which is relatively inexpensive to provide and can be simply and conveniently installed and adjusted.

It is another object to provide a method for installing such an improved roof support system.

These and other objects of the present invention will be more completely disclosed and described in the following specification, the accompanying drawings and the appended claims.

DESCRIPTION OF THE PREFERRED EMBODIMENTS

Figure 1:
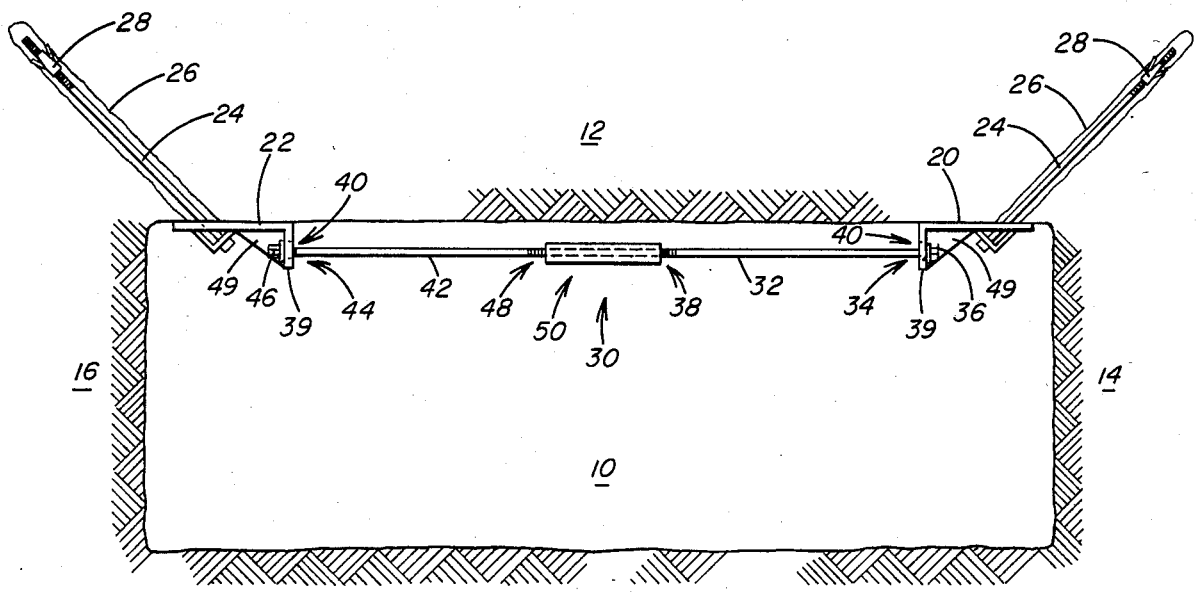
FIG. 1 is an elevational view of a section of a mine or the like including a preferred embodiment of an improved roof support system of the present invention.

As seen in FIG. 1, a typical mine shaft or opening 10 would include a roof 12 between opposing ribs 14, 16. An improved roof support system 18 includes various features of the invention and is of the type which includes a pair of plates 20, 22 which are secured to the roof 12 by inclined cords in the form of roof bolts 24. The roof bolts 24 are installed through bores 26 in a conventional manner with associated anchoring devices 28 being fully installed at the terminal end of each bore 26 to retain the bolt 24 therein and allow tension to be created thereby. It will be seen that any number of such anchoring means could be employed without affecting the specific features of the improvement represented by the present invention. For example, the roof bolts may utilize mechanical, resin or a combination of mechanical and resin bonding to insure proper support of the plates 20, 22 while allowing proper tension to be applied thereto to produce the overall desire resulting forces on the roof 12.

A horizontal, transverse reinforcing member 30 extends between the plates 20, 22. The preferred reinforcing member 30 includes a first rod means 32 having a first end 34 secured to the plate 20 and a second end 38 extending toward the plate 22. Specifically, the first end 34 includes an enlarged head 36, preferably in the form of a bolt head with torque applying surfaces thereon. The bolt head 36 makes abutting contact with a vertically depending portion 39 of the plate 20 as the first rod means 32 extends through a transversely extending opening 40 through the portion 39. Similiarly, the reinforcing member 30 also includes a second rod means 42 which has a first end 44 including an enlarged head 46, such as a bolt head, which is located against the vertical portion 39 of the plate 22 as the second rod means 42 extends through the opening 40 of the plate 22 with a second end 48 thereof extending toward the plate 20. Each plate 20, 22 preferably includes reinforcing elements 49 which may be provided at each side of the vertically depending portion 39 to provide overall strength to the plates 20, 22 even though only one such element 49 may be shown in some of the Figures to simplify the drawings.

Although the particular components provided could be altered while still being within the scope of the invention, it should initially be recognized that the second end 38 of the first rod 32 and the second end 48 of the second rod 42 could include identical threaded means thereon for coupling the first rod means 32 and second rod means 42 to a preferred adjustable coupling means 50 to form the perferred reinforcing member 30. When so coupled for adjustment, the reinforcing member 30 will be capable of producing tension between the plates 20 and 22 which tension may be varied by rotating either enlarged head 36, 46 of the corresponding rod means 32, 42 relative to the coupling means 50. As seen in FIGS. 2 through 7, there are various components of the preferred reinforcing member 30 which are simple to provide and install and are easily adaptable for roof support systems in different locations requiring different transverse distances between the plates 20, 22.

Accordingly, when a plurality of the plates 20, 22 are installed for a series of roof support systems, the overall length of the desired reinforcing memembers 30 can be determined. As will be seen, the design of the preferred opening 40 in the vertically depending portion 39 of each of the plates 20, 22 is such that the overall reinforcing member 30 can be preassembled prior to installation between the plates 20, 22. Specifically, with the preferred first rod means 32 and second rod means 42 being provided in the form of bolts, the openings 40 must be configured to initally receive the bolt heads 36, 46 therethrough. Accordingly, the preferred opening 40 includes a major section 52 which has a cross-section which is sufficient for receiving the bolt heads 36, 46 therethrough. There is also included in the opening 40 an adjoining minor section 54 which has a reduced cross-section smaller than the bolt heads 36, 46 for receipt of a section 56 of the rod means 32, 42 adjacent the bolt head 36, 46 therein. There is included a force bearing surface 58 on the vertically depending portion 39 which surrounds the minor section 54 of the opening 40. Each of the rod means 32, 42 includes a working surface 60 thereon which in the preferred bolt form includes the inside transverse surface of each of the bolt heads 36, 46. After the preferred reinforcing member 30 is fully installed, it will be seen that the working surfaces 60 will be brought into contact with the force bearing surfaces 48 in order to be able to apply the desired tension between the plates 20, 22.

It can now be seen that having determined the overall distance between the vertically depending portions 39 of the plates 20, 22, that one could preassemble each of the reinforcing members 30 for easy installation within the mine shaft 10 after the plates 20, 22 are fully installed. As thus described, it should be clear that numerous alternatives could be made to the preferred configuration of a first rod means 32, a second rod means 42 and a coupling means 50 without departing from the invention as claimed. Specifically, any length of these components could be utilized in order to provide the overall desired length for the reinforcing member 30. Of course, it would be reasonable to expect if the overall distance between the plates 20, 22 were predictable for a particular mine 10, that the first rod means 32 and the second rod means 42 could be identical and have identical lengths which could minimize inventory problems. Additionally, since the preferred first rod means 32 and second rod means 42 are both provided in the form of standard bolts, threaded regions 62, 64 at the respective second ends 38, 48 would be identical right-hand threads. Consequently, the preferred coupling means 50 could be simply provided in the form of a sleeve 66 which has a central bore 68 extending therethrough. The central bore 68 would threaded to match the threaded regions 62, 64.

It might also be noted that each of the preferred bolt heads 36, 46 includes an integrally formed enlarged annular portion to provide the working surface 60. However, if desired, the bolt head could be configured to include a separate washer so that the working surface would actually be the inside transverse surface of the washer installed at the bolt head.

Figure 3:
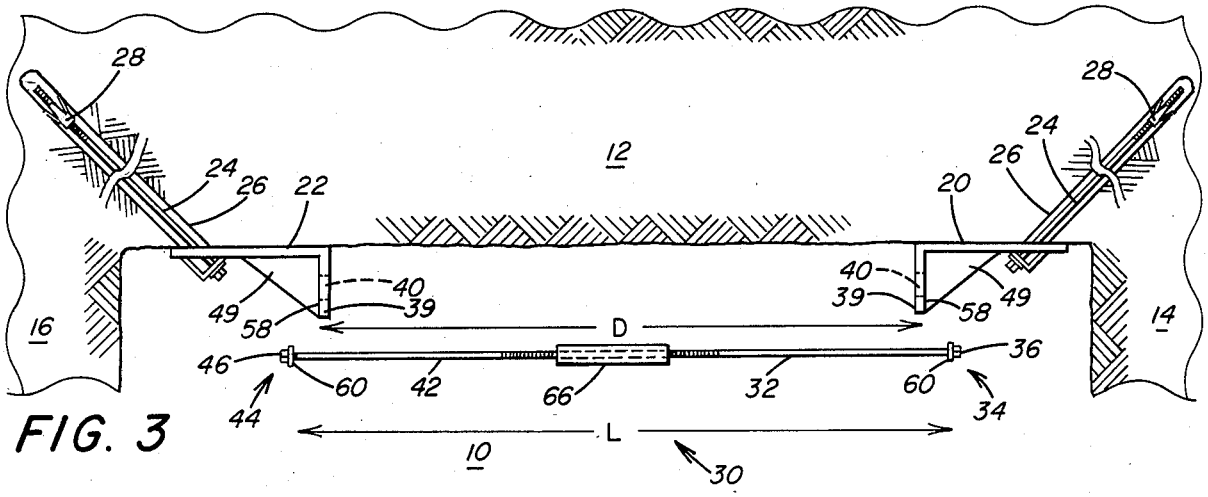
FIG. 3 is a view like that shown in FIG. 1 prior to the horizontal, transverse reinforcing member of the preferred embodiment being installed.

As seen in FIGS. 3 thru 8, the preferred reinforcing member 30 includes a configuration which significantly simplifies its installation and greatly reduces the time required for providing the desired tension between the plates 20, 22. Specifically, as seen in FIG. 3 once the distance D between the force bearing surfaces 58 of the plates 20, 22 is determined, the overall length L of the reinforcing member 30 between its working surfaces 60 can be determined. Consequently, a number of reinforcing members 30 can be preassembled in a shop area remote from the mine 10 to reduce the work which is actually being done in the mine 10. Although shown with greater clearance than required in FIG. 3, the mine operating personel should, with experience, be able to provide the overall reinforcing members 30 with a proper length L which will require minimum adjustment in the mine 10.

Figure 2:
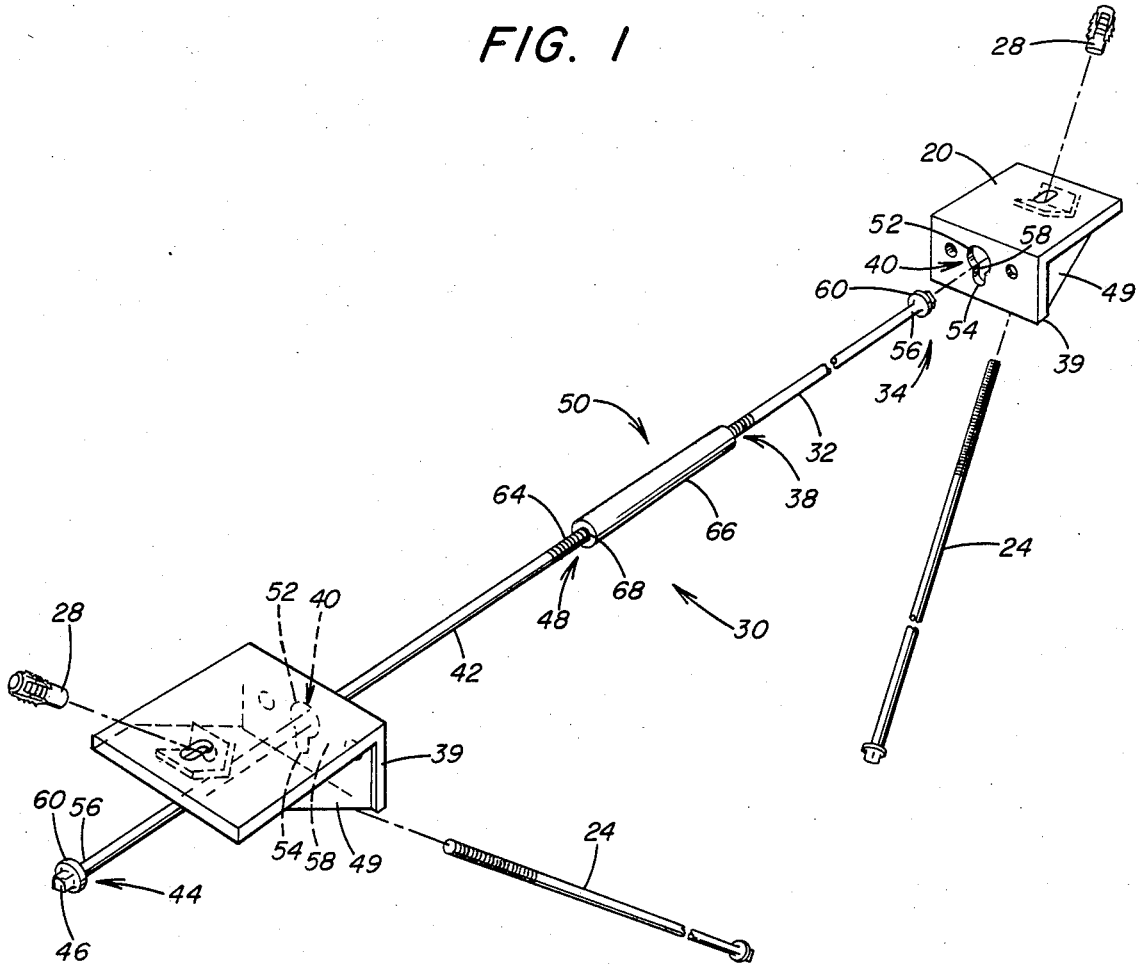
FIG. 2 is an exploded view of the major components of the preferred embodiment as shown in FIG. 1.
Figure 4:
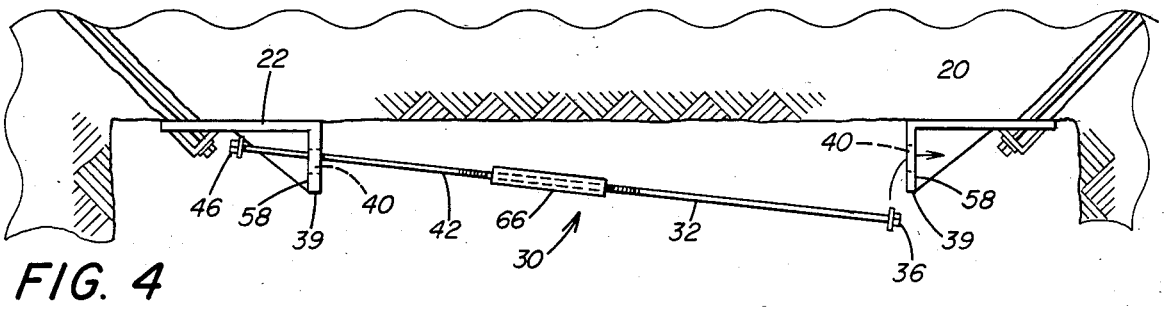
FIG. 4 is a view like that shown in FIG. 3 with the horizontal, transverse reinforcing member partially installed.
Figure 5:
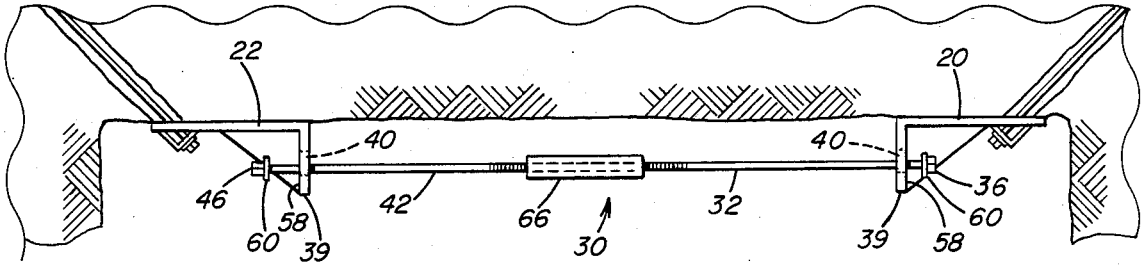
FIG. 5 is a view like that shown in FIG. 4 with the horizontal, transverse reinforcing member in position for adjustment.

As seen in FIG. 4, the preassembled reinforcing member 30 is initially installed with one of the enlarged heads 36, 46 installed through the major section 52 of its corresponding hole 40. As seen in FIG. 5, the other enlarged head 36, 46 is similarly installed through its opening 40 to cause the reinforcing member 30 to be supported generally between the plates 20, 22. Because of the configuration of the preferred openings 40, as seen in FIG. 2, the weight of the reinforcing member 30 will tend to automatically cause the reinforcing member 30 to be repositioned downwardly to cause the sections 56 of the rod means 32, 42 to be received within the minor section 54 of each of the openings 40.

Figure 6:
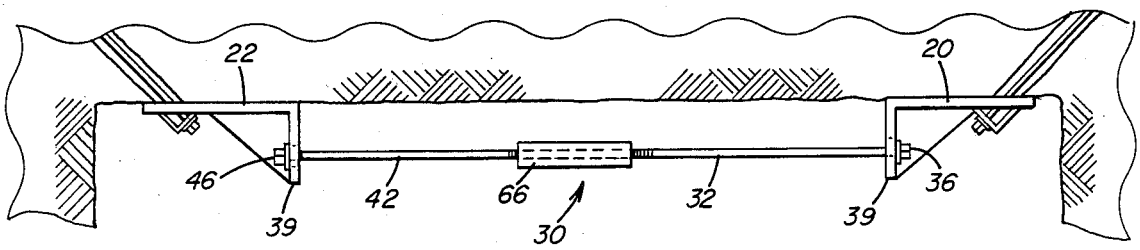
FIG. 6 is a view like that shown in FIG. 5 after adjustment and in position for final tensioning.

As seen in FIG. 6, either of the first rod means 32 or the second rod means 42 can be rotated relative to the preferred sleeve 66 in order to adjust the overall length L of the reinforcing member 30. When properly adjusted, each of the working surfaces 60 of the reinforcing member 30 will be brought into contact with the force bearing surfaces 58 of the plates 20, 22. It is expected that this adjustment could be simply made without the need of any tools by hand rotation of the rod means 32, 42 relative to the sleeve 66. However, as will be seen, the adjustment made in this manner should be such that frictional contact is produced between the working surfaces 60 and the force bearing surfaces 58. As a result, if either rod means 32, 42 is caused to rotate relative the sleeve 66, the other rod means 32, 42 will be prevented from rotation to insure that continued rotation will produce the desired tension between the plates 20, 22.

Figure 7:
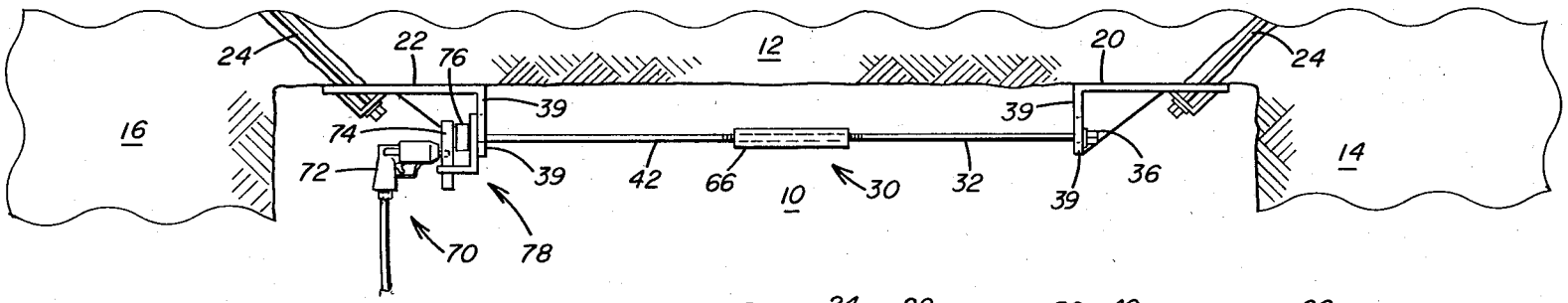
FIG. 7 is a view of the preferred embodiment as seen in FIG. 5 with a preferred tool for providing tension to the roof support system demonstrating its position when tension is being created.
Figure 8:
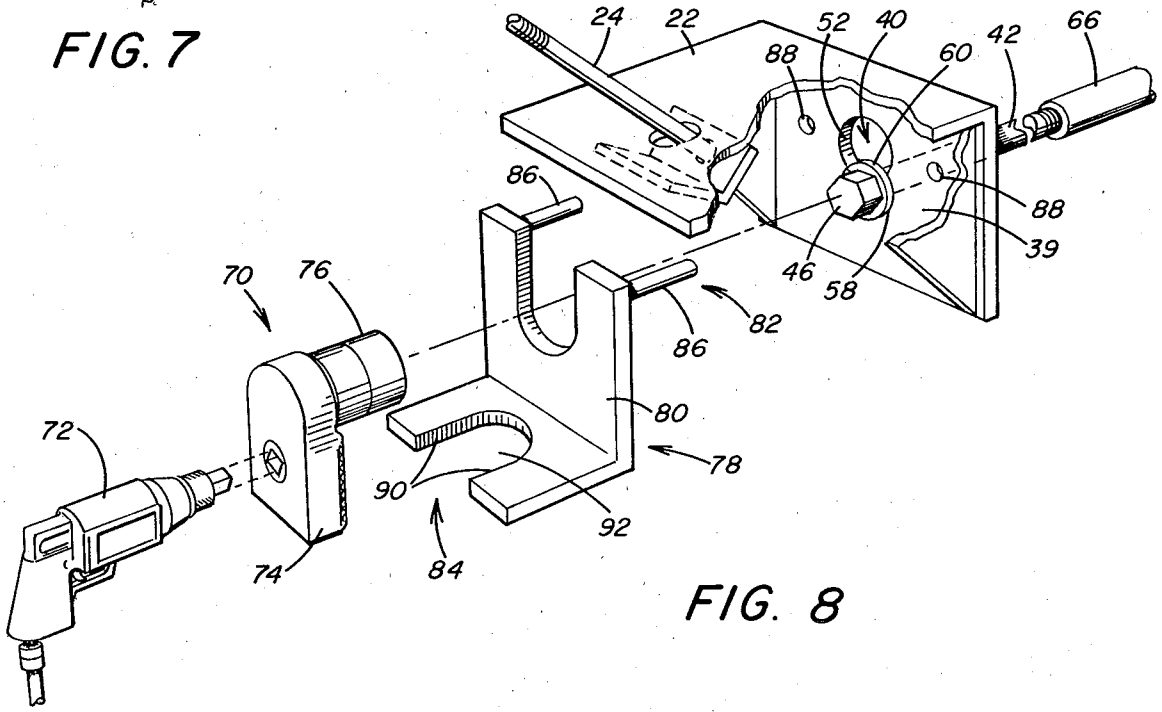
FIG. 8 is an exploded, prespective view of the preferred tool showing its relationship with other components of the preferred improved roof support system.

As seen in FIGS. 7 and 8, the preferred means for power torquing the reinforcing member 30 and creating the desired tension between the plates 20, 22 includes a tool 70. Such a tool 70 must include a source of power and a means for converting the source of power to a rotating torque applying element. It has been found that pressurized hydraulic fluid can provide such a source of power and a hydraulic motor can be utilized as a means for converting the source of power to the proper output. In the preferred tool 70, a hydraulic drill 72 is joined to a speed reducing, force multiplier 74 to provide the output shaft with an output fitting 76 thereon. The output fitting 76 can include a conventional socket fitting design to mate with the conventional bolt head which is utilized in the preferred reinforcing member 30.

However, because of the forces required for properly applying sufficient torque to generate the desired tension between the plates 20, 22, a means must be provided for stabilizing the hydraulic drill 72 and force multiplier 74 to prevent relative rotation thereof with respect to the plate 22 during rotation of the bolt head by the socket fitting. In the preferred tool 70, this is provided by a stablizing means 78 including a bracket 80 which extends between the force multiplier 74 and plate 22. The preferred bracket 80 includes first abutting elements 82 at one end thereof to make abutting contact with the plate 22 and second abutting elements 84 at the other end thereof to make abutting contact with the force multiplier 74. Although any number of configurations could be employed to accomplish such a feature, the preferred bracket 80 has first abutting elements 82 in the form of a pair of rods 86 which extend through corresponding holes 88 in the vertically depending portion 39 of the plate 22. The second abutting elements 84 include the sides 90 of a notch 92 which receives a major body portion of the force multiplier 74 therein when the tool 70 is being employed to produce rotation of the enlarged head 46.

It has been found, for example, that a torque of about 200 foot pounds can be applied to an enlarged head 46 to produce the desired tension between typical plates 20, 22. In one configuration, the force multiplier 74 will reduce the speed while multiplying the output force therefrom at a ratio of about three to one. Accordingly, it has been found that a hydraulic drill 72 can be preset to operate at a maximum output force of about 60 to 70 foot pounds to produce the desired torque needed to insure proper tension between the plates 20, 22. Such a configuration allows for rapid, automatic torsion to be applied to the reinforcing member 30 insuring that the desired tension between plates 20, 22 is provided during initial installation of the preferred roof support system 18.

Figure 9:
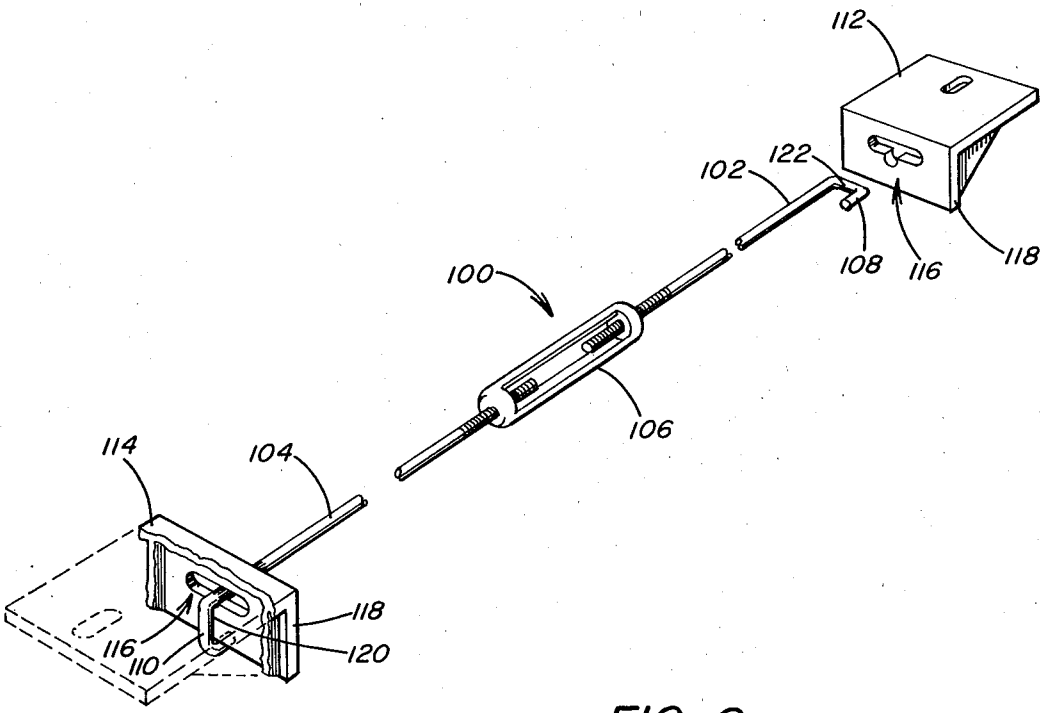
FIG. 9 is an exploded view of an alternative embodiment including various features of the invention.

Although the reinforcing member 30 and plates 20 and 22, as described hereinabove, represent the preferred embodiment of the invention, there are numerous alterations which could be made while still following within the scope of the invention. For example, as seen in FIG. 9, an alternative reinforcing member 100 includes a different first rod means 102 and second rod means 104. The first rod means 102 and the second rod means 104 are adjustably joined by a turn-buckle 106. It is well known that a turn-buckle can be used to join a rod having right-hand threads to a rod having left-hand threads so that rotation of the turn-buckle relative to the two rods will adjust the overall length therebetween. However, it appears that when such turn-buckles were employed in mines or the like in the past, the particular truss configurations included reinforcing elements which were more complicated than the rod means 102, 104 and required more assembly steps to be performed on-site during installation.

Preferably, rod means 102, 104 include enlarged terminal end portions in the form of transversely extending hook means 108, 110. To accommodate the hook means 108, 110, the alternative embodiment shown in FIG. 9 includes alternative roof support plates 112, 114 which perform in the same manner as did the plates 20, 22 described hereinabove. However, plates 112, 114 include a different form of opening 116 in a vertically depending portion 118 thereof.

Specifically, the opening 116 is an elongated hole which has a cross-sectional shape for receipt of the transversely extending hook means 108, 110 therethrough. A force bearing surface 120 on the vertically depending plate 118 is adjacent a part of the opening 116. For the reinforcing member 100, a working surface of each of the hook means 108, 110 includes a transversely extending surface 122 facing away from the rib which is respectively adjacent the first plate 112 and the second plate 114. As a result, the reinforcing member 100 can be installed in a manner similar to that described hereinabove for reinforcing member 30. Specifically, after each of the hook means 108, 110 is respectively received through its corresponding opening 116, the hook means 108, 110 can be reoriented to respecitvely align the transversely extending surfaces 122 thereon with the force bearing surfaces 120 of the first plate 112 and the second plate 114.

After being initially installed in this manner, the reinforcing member 100 can be adjusted to reduce its overall length by rotation of the turn-buckle 106 relative to the rod means 102, 104. Clearly, this configuration is not immediately adaptable to power torquing, but would nevertheless decrease the overall installation time when compared with embodiments disclosed in the prior art patents discussed hereinabove.

It should be recognized that various alterations could be made to the embodiments as described hereinabove without departing from the spirit of the invention as claimed. Specifically, although the preferred plates 20, 22 or the alternative plates 112, 114 are respectively shown to be of the same design for ease of installation and inventory purposes, one or the other could be altered to specifically accommodate a different form of first rod means or second rod means while still being within the scope of the invention. In fact, it should be apparent that the preferred embodiment shown in FIGS. 1–8 could include one of the rod means thereof in a form as generally shown in the embodiment of FIG. 9. In other words, the preferred reinforcing member 30 employs two rod means having identical enlarged end portions with bolt heads thereon but it would be reasonable for one of the rod means to be provided a form of hook or other type of enlarged end portion if desired. Similarly, one of the rod means for the alternative reinforcing member 100 could be provided with a form of bolt head. Clearly, having at least one of the rod means with a bolt head thereon would be advantageous if some form of power tool can be used for providing tension to the reinforcing member. Lastly, although the use of inclined cords to secure the roof support plates is taught and would primarily be employed, it should be recognized that there may be other types of roof support systems which employ such plates and utilize a tension applying reinforcing member therebetween which would still fall in the scope of the present invention.

I claim:

1. An improved roof support system for a mine or the like comprising, a pair of plates secured to a roof of said mine at opposite sides thereof and adjacent opposing ribs of said mine, an elongated reinforcing member extending horizontally and transversely of said mine between said pair of said plates, said reinforcing member having a first rod means and a second rod means and adjustable means for joining said first rod means and said second rod means to vary an overall length of said reinforcing member, at least one of said first and second rod means having an enlarged bolt head end portion formed integral therewith, at least one of said pair of plates having an opening therein to receive said enlarged bolt head end portion of said reinforcing member therethrough, at least one of said plates having a surface adjacent said opening operable to abut at least a part of said enlarged bolt head of said reinforcing member, and said reinforcing member arranged to exert a tension on said first plate and said second plate as said bolt head end portion is urged against said respective plate surface, said tension being varied by rotation of at least one of said rod means in said adjustable means.

2. The improved roof support system as set forth in claim 1, wherein said opening in said plate having a major section having a sufficient cross-section for receipt of said bolt head therethrough and an adjoining minor section having a reduced cross-section smaller than said bolt head for receipt of a section of said rod means thereof adjacent said bolt head therein, said surface plate surrounding said minor section of said opening.

3. The improved roof support system as set forth in claim 2, wherein said reinforcing member includes washer means positioned thereon adjacent at least one of said bolt heads.

4. The improved roof support system as set forth in claim 1, wherein both of said rod means are elongated bolts with bolt heads at one end and external threaded portions at the other end, said adjustable means including coupling means having a threaded central bore to receive said threaded end portions of said first and second rod means, said opening in said other plate having a major section for receiving said bolt head therethrough and an adjoining minor section having a reduced cross-section smaller than said bolt head for receiving a section of said bolt adjacent said bolt head, said plate surface surrounding said minor section of said opening.

5. The improved roof support system as set forth in claim 4, wherein said bolt head includes torque applying surfaces thereon to receive a power torquing means to rotate said bolts.

6. The improved roof support system as set forth in claim 1, wherein said adjustable means includes turnbuckle means between threaded ends of said first rod means and said second rod means opposite from said enlarged terminal end portions thereof.

7. The improved roof support system as set forth in claim 6, wherein said threaded ends of said first rod means and said second rod means are threaded for engagement with said turn-buckle means by relative rotation in opposite directions.

8. The improved roof support system as set forth in claim 7, wherein said first rod means and said second rod means are bolts with said enlarged terminal end portions thereof being bolt heads.

9. The improved roof support system set forth in claim 7, wherein said first rod means and said second rod means include enlarged terminal end portions thereof in the form of transversely extending hook means, said opening in said first and said second plates include a cross-section for receipt of said transversely extending hook means therethrough, said force bearing surface is adjacent part of said opening, said working surface of each of said hook means includes a transversely extending surface facing away from said ribs respectively adjacent said first and said second plates, and each of said hook means is reoriented after being respectively received through said openings to respectively align said transversely extending surfaces thereon with said force bearing surfaces of said first and said second plates.

10. A method of supporting a roof of a mine or the like comprising the steps of:

providing a first rod means with a first end having an enlarged terminal end portion thereof and threaded coupling means on a second end thereof, said terminal end portion of said first rod means having a transversely extending working surface thereon;

providing a second rod means having a first end having an enlarged terminal end portion thereof and a second end thereof which is in threaded engagement with said threaded coupling means on said second end of said first rod means, said terminal end portion of said second rod means having a transversely extending working surface thereon;

providing a first rod support plate and a second roof support plate which are capable of being secured to said roof, said first roof support plate having an opening therein for receipt of said terminal end portion of said first rod means therethrough with a force bearing surface thereon adjacent said opening, said second roof support plate having an opening therein for receipt of said terminal end portion of said second rod means therethrough with a force bearing surface thereon adjacent said opening;

securing said first plate and said second plate at opposite sides of said roof at adjacent opposing ribs of said mine with said force bearing surfaces thereon respectively toward said adjacent ribs, said force bearing surfaces of said first plate and said second plate being a predetermined distance apart;

adjusting an overall length of said first rod means and said second rod means between said working surfaces thereof to slightly exceed said predetermined distance;

inserting said enlarged terminal end portion of one of said first rod means and said second rod means through said opening of a corresponding one of said first plate and said second plate and aligning at least a part of said working surface thereof with said force bearing surface of said corresponding one plate;

inserting said enlarged terminal end portion of the other of said first rod means and said second rod means through said opening of the corresponding other of said first plate and said second plate and aligning at least a part of said working surface thereof with said force bearing surface of said corresponding other plate;

reducing said overall length between said working surfaces of said first rod means and said second rod means by relative rotation of said coupling means and said second rod means to increase said threaded engagement of said second end of said second rod means with said coupling means until said force bearing surfaces are respectively in contact with at least a part of said working surfaces; and producing tension between said first plate and said second plate by continued said relative rotation of said coupling means and said second rod means.

11. The method of supporting a roof as set forth in claim 10, wherein at least one of said enlarged terminal end portions is a bolt head, a corresponding said opening includes a major section having a sufficient cross-section for receiving said bolt head therethrough and an adjoining minor section having a reduced cross-section smaller than said bolt head for receipt of a section of said rod means thereof adjacent said bolt head therein, said working surface is an inside transverse surface of said bolt head, and said inserting said enlarged terminal end portion includes extending said bolt head through said major section of said opening and shifting said rod means to cause it to be received within said minor section of said opening as said inside transverse surface of said bolt head is brought into contact with said force bearing surface surrounding said minor section of said opening.

12. The method of supporting a roof as set forth in claim 11, wherein said bolt head includes torque applying surfaces thereon and said producing tension between said first plate and said second plate includes applying a power torquing means to said torque applying surface to produce said relative rotation of said coupling means and said second rod means.

13. The method of supporting a roof as set forth in claim 10, wherein said threaded coupling means on said second end of said first rod means includes turn buckle means and said reducing said overall length between said working surfaces of said first rod means and said second rod means includes relative rotation of said turn buckle means relative to said first rod means and said second rod means.

14. The method of supporting a roof as set forth in claim 10, wherein at least one of said enlarged terminal end portions is in the form of a transversely extending hook means, a corresponding said opening includes a cross-section for receipt of said transversely extending hook means therethrough, said force bearing surface is adjacent part of said opening, said working surface of said hook means includes a transversely extending surface facing away from said rib respectively adjacent thereto, and said inserting said enlarged terminal end portion includes extending said hook means through said opening to be then reoriented for respective alignment of said transversely extending surface thereon with said force bearing surface.

* * * * *